United States Patent [19]

Cloostermans-Huwaert

[11] 4,402,766

[45] Sep. 6, 1983

[54] PROCESS OF MANUFACTURING OF ALUMINIUM WIRE RODS

[75] Inventor: Leo Cloostermans-Huwaert, Maarkedal, Belgium

[73] Assignee: Lamitref Aluminium, Hemiksem, Belgium

[21] Appl. No.: 357,634

[22] Filed: Mar. 12, 1982

[30] Foreign Application Priority Data

Mar. 23, 1981 [LU] Luxembourg ..... 82349

[51] Int. Cl.[3] ..... C22F 1/04

[52] U.S. Cl. ..... 148/11.5 A; 148/12.7 A

[58] Field of Search ..... 148/11.5 A, 12.7 A, 148/12 B, 11.5 R, 12.7 R

[56] References Cited

U.S. PATENT DOCUMENTS 3,331,711 7/1967 Kemppinen et al. ..... 148/12.7 A

*Primary Examiner*—M. J. Andrews

*Assistant Examiner*—Debbie Yee

*Attorney, Agent, or Firm*—Edward J. Brenner

[57] ABSTRACT

A process of manufacturing wire rods of precipitation hardenable aluminium. The first step of the process comprises an exclusively thermic step of continuously quenching a continuous bar for obtaining a restored and supersaturate structure. The second step immediately follows the first step in a same continuous operation and comprises the working, preferably rolling, of the bar at aging temperature into wire rods, which are subsequently submitted to aging.

12 Claims, No Drawings

PROCESS OF MANUFACTURING OF ALUMINIUM WIRE RODS

The invention relates to a process of manufacturing of wire rods of precipitation hardenable aluminium. This process is in particular applicable to aluminium for electrical conductor wire, i.e. aluminium that can be treated to wire with a resistivity of maximum 32,8 milliohms×mm$^2$/m, although not limited to that type of aluminium which comprises, as alloying elements for precipitation, 0.3 to 0.9% of Magnesium, 0.25 to 0.75% of Silicon and 0 to 0.60% of iron, the balance being aluminium and impurities (i.e. elements in a quantity of less than 0.05%), percentages by weight. Wire rods are, as well known, the starting product for subsequent drawing or rolling, in which the cross-section of the aluminium wire is reduced. The wire rods have in general a diameter of 5 to 20 millimeter, in most cases between 7 and 12 millimeters, and a tensile strength considerably less than the tensile strength of the final product obtained by drawing, for instance, for the abovementioned aluminium for electrical conductor wire, a tensile strength of less than 250 Newton/mm$^2$, at any rate less than 300 N/mm$^2$. As well known, after drawing, the wire is submitted to an aging operation, in which precipitates are formed of the alloying elements which still had remained in solution, and this aging operation improves the mechanical and electrical characteristics of the wire.

The conventional production process of aluminium wire rods comprises a first step of hot rolling, in which coils of wire rods are formed, followed by a discontinuous solution treatment and quenching of the coils obtained by hot rolling. Otherwise indeed, when the coils are simply cooled down after rolling, the alloying elements come to precipitate with the result that there are no alloying elements in solution any more for the subsequent aging. This is the reason why these elements are brought in solution again after rolling, and are forced to remain in supersaturated solution after the immediately subsequent quenching operation.

This solution treatment is expensive with respect to heating-energy, and moreover requires that the manufacturing be conducted in a discontinuous way. This is why it has been proposed before to end the said first step of hot rolling at a temperature as high as possible, in order to keep a maximum amount of alloying elements in solution, and to quench the wire rods, immediately and in a continuous process downstream the exit of the rolling-mill, to a quenching temperature, in such a way as to keep these alloying elements in supersaturated solution.

At such quenching temperature, the mobility of the atoms is so low, that the metallographic structure gets practically stuck in the state as it is (apart of aging phenomena): the alloying elements which have remained in supersaturated solution will so remain and the precipitates and dislocations do not change. For a given alloy, the range of "quenching temperatures" has consequently an upper limit which is not a strict and absolute limit. This upper limit is determined by a sufficient immobility of the atoms which does not produce a substantial change of the metallographic structure during a time period of the order of magnitude of a continuous process of treatment of aluminium, i.e. of the order of magnitude of one minute. The acceptable maximum limit for each type of alloy is sufficiently known by the man skilled in the art. For the abovementioned aluminium for electrical conductor wire, the maximum quenching temperature can be put at 260° C., although this limit is not an absolute limit.

It has also been proposed to use a first hot rolling step which ends at a temperature as high as possible, in order to keep a maximum of alloying elements in solution, followed by a quenching during which the metal is worked, and taking care that the metal be worked during the period in which it traverses the temperature range between the maximum quenching temperature limit and the minimum temperature limit for hot working. Notwithstanding the fact that a quenching was conducted, it was observed that the alloying elements in solution did precipitate during this thermo-mechanical operation. The quantity of alloying elements kept in solution for the subsequent aging step showed to be much less than desirable, and this seemed to be a drawback. But it was observed that the so obtained wire rods were of that sort that, according as the precipitation had been partial or total, the necessity of aging after subsequent drawing was eliminated, either partially or totally. Consequently, the expected drawback did not exist, and wire rods were obtained with properties which allowed to meet more easily the prescribed requirements for the mechanical and electrical characteristics of the wire drawn from such wire rods. Moreover, the expensive step of solution treatment was avoided, and a continuous process was obtained.

It is an object of the present invention to provide an alternative for this latter process, procuring the same advantages, and giving in this way an additional degree of freedom in the choice of the parameters of the process for obtaining the desired combinations of tensile strength, ductility and conductibility.

The process according to the invention comprises a first exclusively thermic step (this means: not with simultaneous working operation) in which a continuous bar of said aluminium (which, for instance, leaves a rolling-mill and in a partially cooled-down state, or which leaves a continuous casing wheel or an extrusion press is quenched in a continuous process down to a quenching temperature, as determined herabove, whereby a restored structure is obtained with the alloying elements in supersaturated solution. By "restored structure" is meant a metallographic structure in which the grains, elongated by the working step, have reorganized under influence of heat into a more or less isotropic structure, which is the structure obtained after hot working. A minimum amount of alloying elements in supersaturation is also necessary, for instance at least 30% of the precipitatable elements at the temperature of solution treatment. The quenching is consequently sufficiently rapid and starts from a sufficiently high temperature to reach that goal.

The process according to the invention is however characterized by a second step, thermo-mechanical and downstream the first one in a same continuous operation, in which said bar is worked at an aging temperature, and by the fact that the so obtained wire rods are subsequently, before any subsequent working, submitted to an aging operation.

An "aging temperature" is a temperature inside a temperature range of which the maximum limit is equal to the maximum quenching temperature limit, as determined hereinabove, and of which the minimum limit is determined hereunder. An aging temperature is consequently a temperature at which the atoms are immobilized, apart from aging phenomena which occur in a time period, longer than the duration of a continuous process, i.e. of the order of magnitude of one minute. However, when the structure is submitted to working at aging temperature, it has been observed that the precipitation of the alloying elements during such working and during a subsequent aging procures a metallographic structure, which, after cold working into wire, shows a very good wire quality and which eliminates, partially or in totality, according as there are still alloying elements left in supersaturated solution, the necessity of aging after wire drawing. Such working at aging temperature is preferably a rolling which reduces the cross-sectional area.

For a given aluminium alloy, the minimum limit for the aging temperature will be determined hereunder. It is known that an aluminium alloy of a given composition, in a not cold worked state, but comprising alloying elements in supersaturated condition by solution treatment and quenching down to a quenching temperature, when such aluminium alloy is submitted to aging, will firstly show a rise of tensile strength towards a maximum value, and then show a fall of its tensile strength. This is due to the fact that the alloying elements precipitate during aging whilst the already existing precipitates further conglomerate. The first effect, which makes the tensile strength to increase, initially dominates, whilst the second effect, which makes the tensile strength to fall, dominates at the end. The minimum limit for the aging temperature, for a given aluminium alloy with a given quantity of alloying elements in supersaturated solution, is the temperature in which this aluminium, in non cold worked state, reaches its maximum tensile strength after three days (The cold worked structure reaches its maximum earlier, due to the softening of the cold worked structure). For the abovementioned aluminium for electrical conductor wire, this minimum limit is about 130° C.

An important point in the process is, that the second step is conducted immediately after the quenching operation of the first step (in order not to allow any changement of the structure when the intermediate product is left without treatment for a certain time), and consequently in a same continuous operation with the first step. To that end, it is preferred to conduct the quenching of the first step down to an aging temperature, as determined above, so that the second step can be started without any intermediate heating.

The aging operation following said working step at aging temperature can be conducted directly at the exit of the instrument which executes such working, for instance by free cooling to the ambient air of the wire rods, and this provokes a precipitation of the totality or only a part of the alloying elements still left in supersaturation. It can be said that an aging takes place when a considerable part, for instance half the amount of precipitatable elements after quenching, precipitates indeed during such aging. It is however preferred to conduct a total precipitation, in order to eliminate all necessity of aging after wire drawing and to eliminate all changements of properties of the wire rods after their manufacturing. When the temperature at the exit of the instrument, which executes the operation of working at aging temperature, comes near to the minimum limit of aging temperatures, it will sometimes be necessary to slow down the cooling of the wire rods at said exit (i.e. slower than the free cooling to the ambient air). This is done by surrounding the wire rods by heat insulators, for instance, by forming wire coils which are enclosed in sufficiently closed boxes for avoiding cooling-down by air convection. The wire rods can also be kept for a certain time period, by heating, at the said exit temperature, or the temperature can even be raised above exit temperature, in so much as a subsequent aging is then conducted.

The continuous bar which is used at the start of the first step of the process can be a bar which leaves a hot forming instrument, such as an extrusion press or a casting wheel. Such hot forming operation will preferably comprise a continuous casting operation which delivers an aluminium skein which is directed towards the entry of a rolling mill, and a hot rolling process by which the cross-sectional area of said skein is reduced for forming said bar. By "hot" rolling is meant a rolling with restoration during the operation or immediately thereafter, before the subsequent quenching. For the abovementioned aluminium for electrical conductor wire, this means a rolling with exit temperature of more than 350° C. The temperature at the entrance of the rolling-mill will preferably be a temperature which exceeds the solution treatment temperature, which means, for the aluminium for electrical conductor wire, a temperature higher than 470° C.

The invention is particularly applicable to the aluminium for electrical conductor wire of which the composition is given hereinabove. In a preferred mode, a continuous process will be used, which comprises, in sequence from upstream to downstream: a continuous casting operation, the introduction of the skein that leaves the continuous casting instrument and at a temperature of more than 470° C. into a first rolling-mill, the continuous rolling at a temperature of more than 350° C. for forming a continuous bar, the continuous quenching of said bar at the exit of said first rolling-mill, the introduction of said bar that leaves the quenching instrument and at a temperature of more than 130° C. into a second rolling-mill, the continuous rolling at a temperature of more than 130° C., and the aging by free cooling by the ambient air. The entrance temperature of the second rolling-mill is to be controlled so as to obtain an exit temperature of the rolling mill ranging from 155° to 185° C., preferably 175° C.

An Al-Mg-Si of the type 6201 has for instance been used having the following composition: Mg: 0.60%; Si: 0.55%; Fe: 0.18%; Zn: 0.006%; Cu: 0.004%; Mn: 0.015%; Ti: 0.001%; V: 0.004%. An aluminium can however be used which is richer or poorer in alloying elements, depending on the cost that can be afforded or must be saved for a better or less good quality due to the composition. But this does not affect the possibilities for the chosen alloy to improve the quality by using the process according to the invention.

The alloy of the composition above, after leaving a continuous casting wheel in the form of a skein having a cross-sectional area of about 2000 $mm^2$, is introduced at a temperature of 490° C. into a first continuous rolling mill with 9 passes. It leaves said rolling mill in the form of a round bar of a diameter of 15 mm and at a temperature of 430° C. At this temperature most of the alloying elements are still in solution, because, in state of equilibrium, only 20% of the Magnesium and Silicon, precipitatable in the form of $Mg_2Si$, is then in precipitated form.

This bar, which leaves said first continuous rolling mill at a speed of about 2,4 m/sec, is then directed towards the entry of a second continuous rolling mill, of which the entrance is located at about 2 meters from the exit of the first one. Between both, the bar passes through a tube of 30 mm diameter and 1 meter length, which is supplied by a refrigerating emulsion in counter-current, of which the throughput is controlled in such a way that the bar leaves the tube at a temperature of 220° C. Other ways of quenching can also be used, for instance by squirts of emulsion directed towards the bar, in so much as the temperature can be controlled at the desired temperature.

The second continuous rolling mill comprises four passes with equal cross-sectional reduction, which reduces the bar into wire rods of 9,5 mm diameter, which leave said second rolling mill at a temperature of 175° C. and at a speed of about 6 meter per second. The wire rods are subsequently coiled up and the coil is placed in a container made of refractory brick. The important point is, that the container be closed so that cooling-down by free air convection around the coil be avoided. In the case of the example, the cooling-down had a rate of 2° C. per hour.

The obtained properties can now be compared with the properties obtained with wire rods of the same composition, made by the conventional method which is: continuous casting followed by a continuous hot rolling, coiling-up into coils which freely cool down in the ambient air, subsequently a solution treatment in which the coils are kept in a furnace during 8 hours at a temperature of 550° C., and then quenching the coils down to a temperature of about 45° C.

These two types of wire rods of a diameter of 9,5 mm, the one according to the invention, the other one according to the conventional method are then drawn into wire, down to 3,60 mm diameter and then further to 3,15 mm. The drawn wire obtained by the conventional method is then subsequently submitted to an aging operation during 5 hours at 160° C. The comparative results are as follows:

| | According to invention | | | Conventional method | | |
|---|---|---|---|---|---|---|
| | R | $\sigma$ | $\rho$ | R | $\sigma$ | $\rho$ |
| Wire rods | 304 | 7.75 | 31.10 | 196 | 21 | — |
| After drawing to 3,60 mm | 348 | 5 | 31.30 | 285 | 4.5 | 34.9 |
| After drawing to 3,60 mm + aging | — | — | — | 343 | 7.5 | 32.13 |
| After drawing to 3,15 mm | 362 | 4.5 | 31.44 | 290 | 4 | 34.70 |
| After drawing to 3,15 mm + aging | — | — | — | 350 | 7 | 31.95 |

R = tensile strength in Newton/mm$^2$
$\sigma$ = *ductility* (%)
$\rho$ = *resistivity* (m$\Omega$mm2/m)

The invention is not limited, neither to the specific mode of the operations given in the example, nor to the composition of the aluminium. It is also possible, without exceeding the scope of the present invention, to use, as an aluminium with precipitatable alloying elements, the alloys Al-Cu, Al-Cu-Mg, Al-Zn-Mg, Al-Zn-Mg-Cu and Al-Mg-Si.

I claim:

1. A continuous process of manufacturing wire rods of Al-Mg-Si alloy suitable for electrical conductor wire, the process comprising (a) continuously quenching in an exclusively thermic step a continuous bar of said aluminium alloy to a quenching temperature whereby a restored structure is obtained with the alloying elements in supersaturated solution;

(b) continuously rolling said bar at an aging temperature, in the same continuous operation downstream the quenching and (c) before any subsequent working, aging the so obtained wire rods.

2. A process according to claim 1, characterized by the fact that said aging operation is conducted during a free cooling to the ambient air of said wire rods immediately after said working step at aging temperature.

3. A process according to claim 1, characterized by the fact that said aging operation is conducted during a slowed-down cooling of the wire rods, immediately after the working at aging temperature.

4. A process according to claim 1, characterized by the fact that said aging operation is conducted by keeping the wire rods, by heating, at aging temperature, immediately after the working at aging temperature.

5. A process according to any one of claims 1 to 4, characterized by the fact that the continuous bar used at the start of said first step is a bar which leaves a hot forming instrument.

6. A process according to claim 5, characterized by the fact that said hot forming comprises a continuous casting operation which delivers an aluminium skein which is directed towards the entry of a rolling mill, and a hot rolling operation by which the cross-sectional area of said skein is reduced for forming said bar.

7. A process according to claim 6, in which the entrance temperature of said skein is a temperature higher than the solution treatment temperature.

8. A process according to claim 1, characterized by the fact that the said bar is quenched in the first step to an aging temperature.

9. A process according to claim 1, characterized by the fact that the aluminium comprises 0.3 to 0.9% of magnesium, 0.25 to 0.75% of silicon and 0 to 0.60% of iron, the balance being aluminium and impurities.

10. A process according to claim 9, characterized by the fact that in said second step, the bar is worked at a temperature ranging from 130° C. to 260° C.

11. A process according to claim 10, characterized by the fact that said bar is worked in a continuous rolling mill, which is left by the wire rods at an exit temperature ranging from 155° C. to 185° C., and that the wire rods are coiled up and that the so formed coils are subsequently cooled down in a closed container.

12. A process according to claim 11, characterized by the fact that the continuous bar used at the start of said first step is a bar which leaves a continuous rolling mill in which the aluminium is worked at a temperature which varies from a temperature exceeding 470° C. at the entrance of the rolling mill down to a temperature not lower than 350° C. at the exit.

* * * * *